US006162075A

United States Patent [19]

Hara et al.

[11] Patent Number: 6,162,075

[45] Date of Patent: Dec. 19, 2000

[54] PC CARD CONNECTOR

[75] Inventors: Tomohisa Hara, Nagano, Japan; Hung-Chi Yu, Hsi-Chih, Taiwan

[73] Assignee: Hon Hai Precision Ind. Co., Ltd., Taipei Hsien, Taiwan

[21] Appl. No.: 09/416,867

[22] Filed: Oct. 13, 1999

[30] Foreign Application Priority Data

Jul. 2, 1999 [TW] Taiwan ..... 88211060

[51] Int. Cl.[7] ..... H01R 13/62

[52] U.S. Cl. ..... 439/159

[58] Field of Search ..... 439/152–160, 439/64

[56] References Cited

U.S. PATENT DOCUMENTS

| | | | |
|---|---|---|---|
| 5,290,174 | 3/1994 | Woratyla et al. | 439/377 |
| 5,324,204 | 6/1994 | Lwee | 439/159 |
| 5,507,658 | 4/1996 | Ho | 439/159 |
| 5,536,180 | 7/1996 | Ishida et al. | 439/159 |
| 5,558,527 | 9/1996 | Lin | 439/159 |
| 5,575,669 | 11/1996 | Lin et al. | 439/160 |
| 5,695,351 | 12/1997 | Kimura et al. | 439/159 |
| 5,846,096 | 12/1998 | Ishida | 439/159 |
| 5,967,813 | 10/1999 | Ho et al. | 439/159 |

*Primary Examiner*—Gary F. Paumen
*Attorney, Agent, or Firm*—Wei Te Chung

[57] ABSTRACT

A PC card connector comprises a header connector, a shielding cover and an ejector mechanism. The ejector mechanism includes ejector means and actuation means. The actuation means includes an elongate base and an elongate rod received in the base. A slider is movably mounted between the base and the rod. A depression is defined in a top surface of the rod. A bracket mounted to the shielding cover is adapted to receive the rod and the base. An aperture is defined in the bracket aligned with the aperture of the rod. An elongate lock plate has a stop tab and a spring tab. The stop tab is inserted through the aperture of the bracket and movable into and out of the depression of the rod when the PC card engages with the spring tab.

3 Claims, 7 Drawing Sheets

PC CARD CONNECTOR

BACKGROUND OF THE INVENTION

The present invention generally relates to a PC (Personal Computer) card connector, and particularly to a PC card connector having an ejector mechanism including a rod, which is protected from being damaged by external forces.

A PC card connector is commonly disposed in a notebook computer or another compact electrical device for electrically engaging with a PC card. The PC card such as a network card, a memory card, or a video card can be inserted into or ejected from the PC card connector. Thus, the PC card connector can serve many functions without compromising space within the notebook computer. The PC card connector includes a number of contacts for signal transmission which usually mate with the PC card with a high retention force. In addition, the PC card connector and the inserted PC card are completely disposed within the computer thereby impeding manual withdrawal of the PC card.

A one-step ejector mechanism is commonly used in the PC card connector for ejecting the PC card therefrom. Such an ejector mechanism mounted to the PC card connector includes an ejector lever pivotally mounted to an insulative housing of the PC card connector and a rod pivotally connected to the ejector lever. The rod is manually activated to pivot the ejector lever thereby ejecting the PC card out of the PC card connector. However, when the PC card is fully inserted into the PC card connector, the rod is pushed by the ejector lever to partially extend out of the computer. An external force may inadvertently act on the exposed rod thereby possibly adversely affecting the operation of the PC card connector or damaging the rod.

A two step ejector mechanism such as the one disclosed in U.S. Pat. Nos. 5,536,180 and 5,846,096, is adopted to solve the above-mentioned problem. Referring to FIGS. 1A and 1B, a PC card connector has a lateral portion with a conventional two step ejector mechanism 6 assembled thereto. The ejector mechanism 6 includes a rod 610, a base 611 mounted to the lateral portion of the PC card connector, a spring 614, a cover 615 and ejector means 620. The rod 610 is movably received in the base 611. One end of the spring 614 is assembled to a post 615 of the base 611 and another end of the spring 614 is received in an elongate hole 616 of the rod 610 thereby providing elastic engagement between the base 611 and the rod 610. The rod 610 has an actuation portion 6100 extending out of the base 611 for being manually pushed and a fastener 617 downwardly extending therefrom.

The ejector mechanism 6 further includes an insulative slider 612 and a metal leaf spring 618. The slider 612 serving as a cam includes a pin 6121 downwardly projecting therefrom proximate one end thereof and a hole 6122 defined therethrough proximate another end thereof. The leaf spring 618 defines an aperture (not shown) therethrough. In assembly, the fastener 617 of the rod 610 extends through the aperture and the hole 6122 for mounting the slider 612 and the leaf spring 618 together to the base 611. A heart-shaped island 613 is formed in the base 611 and a channel 6110 is defined therearound. The pin 6121 of the slider 612 is movably received in the channel 6110. The leaf spring 618 is adapted to downwardly abut against the slider 612 thereby preventing the pin 6121 from becoming disengaged from the channel 6110. The ejector means 620 includes an actuation end 6200 which can be pushed by the slider 612.

To eject the PC card from the PC card connector, the rod 610 is manually pushed inward to a portion which allows the spring 614 to expand and outwardly push the rod 610. The rod 610 is then inwardly pushed again to actuate the ejector means 620 and eject the PC card out of the PC card connector. The spring 614 compresses to its minimum length and the rod 610 is fully received in the base portion.

However, when no PC card is engaged in the connector, inadvertent force can act to release the rod outward from the connector, and then to damage the rod or ejector mechanism.

SUMMARY OF THE INVENTION

Accordingly, a purpose of the present invention is to provide a PC card connector having an ejector mechanism including a rod, the rod normally projecting from the connector only during the process of card ejection, and the rod being enabled to project form the connector only when a PC card is engaged in the connector, thereby preventing damage to the rod and the mechanism by external forces.

To fulfill the above-mentioned purpose, a PC card connector in accordance with the present invention comprises a header connector, a shielding cover and an ejector mechanism. A receiving space is defined proximate the header connector for receiving an inserted PC card. The ejector mechanism includes ejector means and actuation means. The ejector means is adapted to eject a fully inserted PC card from the header connector. The actuation means includes an elongate base and an elongate rod received in the base. A slider is movably mounted between the base and the rod. The rod defines a recess for receiving the slider. A depression is defined in a top surface of the rod.

The ejector mechanism further includes a bracket adapted to receive the rod and the base of the actuation means. The bracket engages with a side wall of the shielding cover thereby securing the actuation means thereto. An aperture is defined in the bracket aligned with the depression of the rod.

An elongate lock plate has one end mounted to the bracket. A stop tab and a spring tab extend from another end of the lock plate. The stop tab is inserted through the aperture of the bracket and into the depression of the rod thereby preventing any movement of the rod relative to the bracket. The spring tab extends into the receiving space. When a PC card is inserted into the receiving space, a top surface of the PC card upwardly abuts against the spring tab thereby raising the lock plate. Therefore, the stop tab disengages with the depression and the rod can to be moved in a direction parallel to a direction in which the PC card is inserted into the receiving space.

DETAILED DESCRIPTION OF THE PREFERRED EMBODIMENT

Figure 1A:
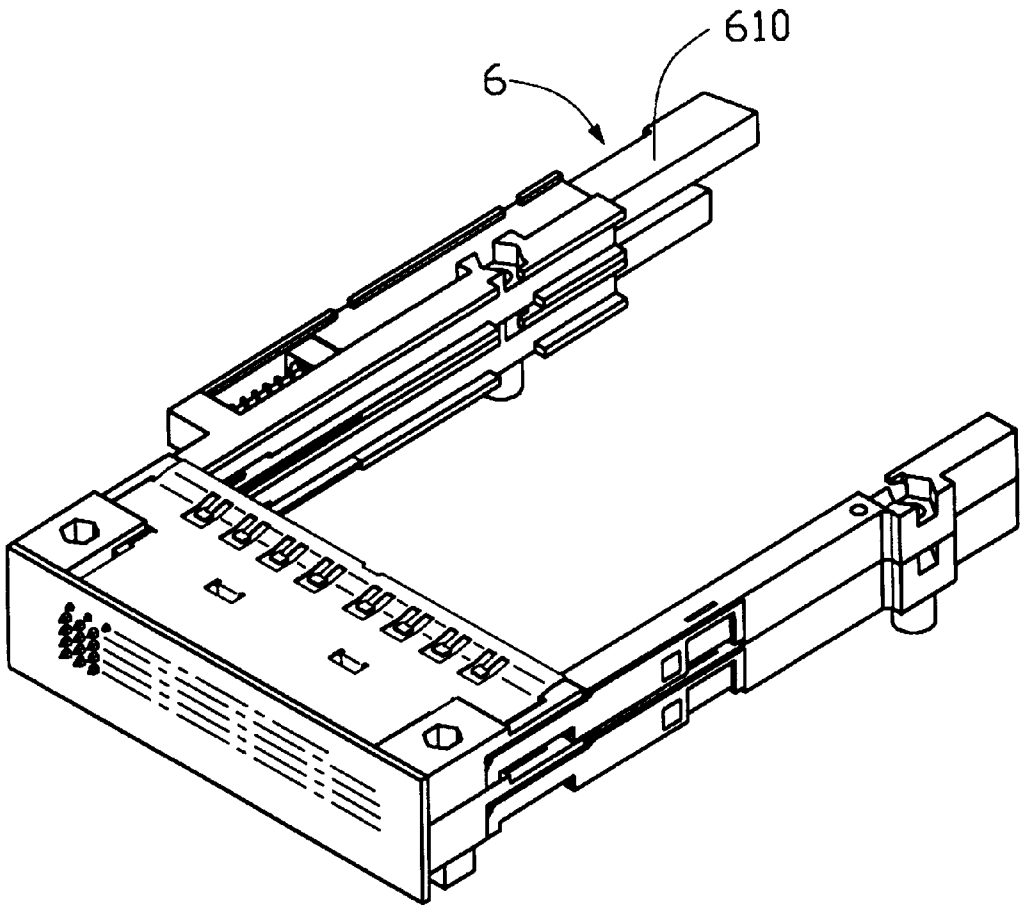
FIG. 1A (PRIOR ART)
FIG. 1A is a perspective view of a conventional PC card connector.
Figure 1B:
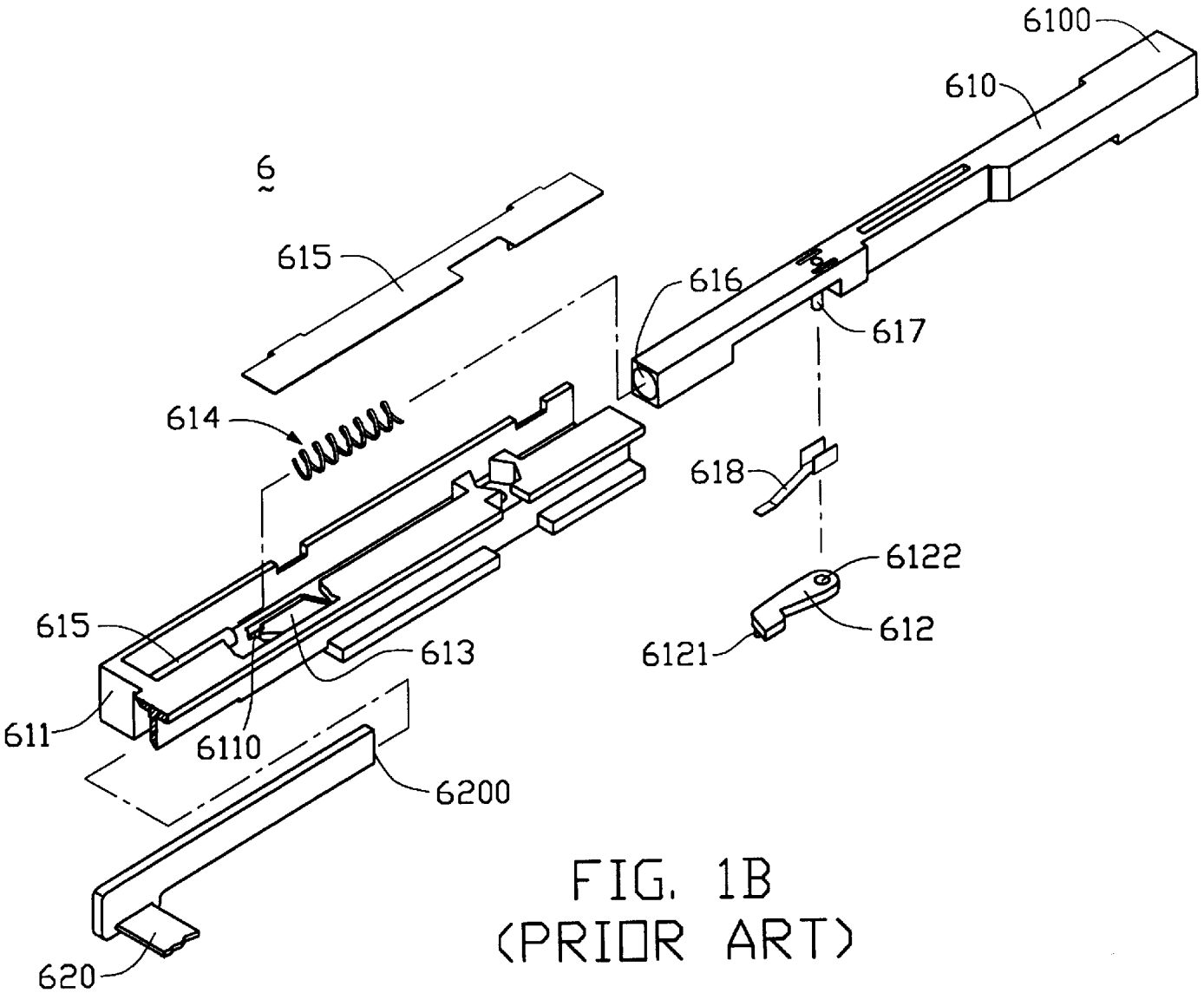
FIG. 1B (PRIOR ART)
FIG. 1B is an exploded view of an ejector mechanism of the conventional PC card connector.
Figure 2:
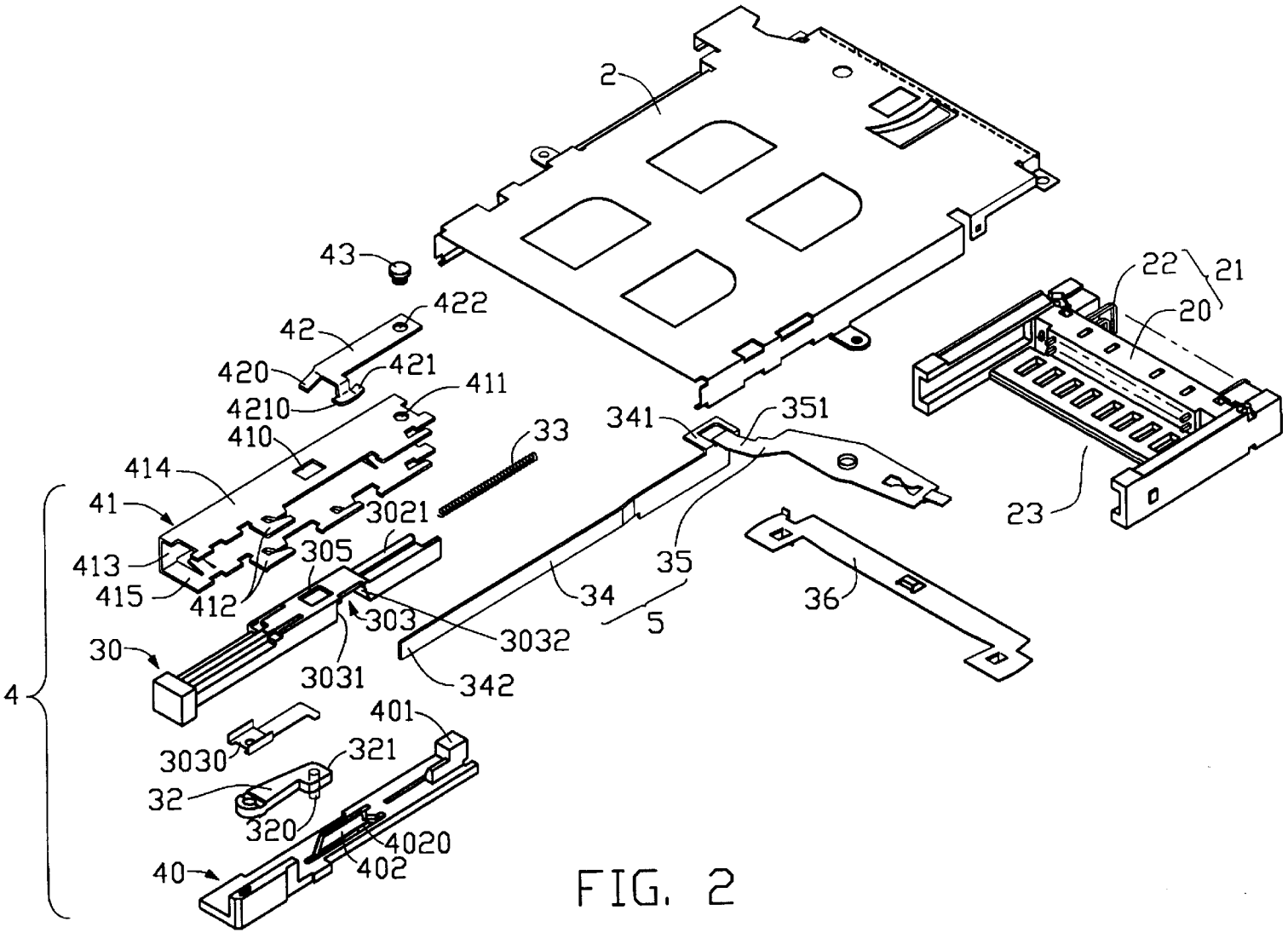
FIG. 2 is an exploded view of a PC card connector in accordance with the present invention.
Figure 5A:
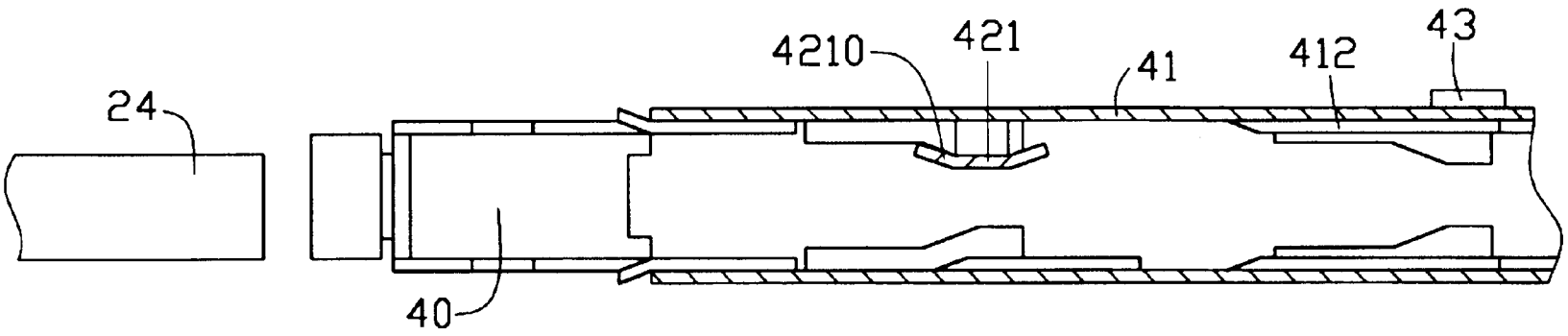
FIG. 5A is a side and cross-sectional view of the PC card connector highlighting operation of a lock plate before a PC card is inserted thereinto.
Figure 5B:
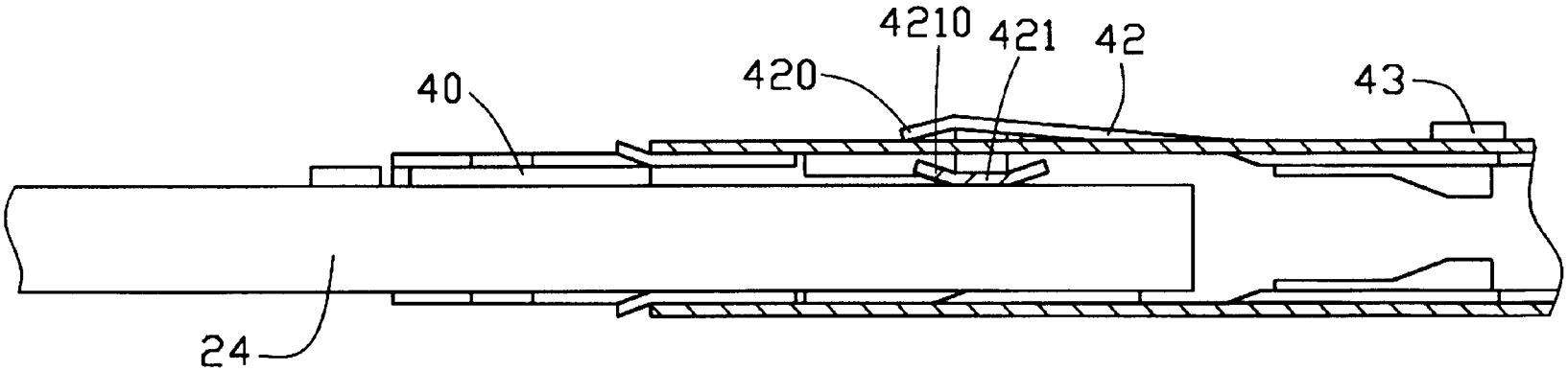
FIG. 5B is similar to FIG. 5A when the PC card is inserted thereinto.

Referring to FIG. 2, a PC card connector in accordance with the present invention comprises a header connector 21, a shielding cover 2 and ejector means 5 and actuation means 4. The head connector 21 includes an insulative housing 20 and a plurality of conductive terminals 22 retained in the housing 20 for signal transmission purposes. A receiving space 23 is defined proximate the housing 20 for receiving an inserted PC card 24 (FIGS. 5A and 5B). The shielding cover 2 is attached to a top of the header connector 21 for shielding the terminals 22 and the PC card 24 from external interference signals.

The ejector means 5 includes a first lever 35 and a second lever 34. The first lever 35 is arranged substantially parallel to a longitudinal direction of the header connector 21 and is pivotally mounted to an elongate fixing plate 36. The fixing plate 36 is mounted to the housing 20. The first lever 35 is adapted for ejecting the PC card 24 out of the PC card connector. The first lever 35 includes an actuation end 351 proximate a lateral edge of the PC card connector. The second lever 34 includes a first end 341 pivotally connected to the actuation end 351 of the first lever 35 for actuating the first lever 35, and a second end 342.

The actuation means 4 includes an insulative base 40, a rod 30, a compression spring 33, a leaf spring 3030, a cam slider 32 and a bracket 41. The rod 30 is slidably attached to the base 40. The base 40 includes a heart-shaped island 402 forming a cam channel 4020 therearound. The rod 30 defines a recess 303 in a bottom surface thereof and a groove 3031 in communication with the recess 303. The leaf spring 3030 is mounted to a top inner wall of the groove 3031. The slider 32 is received in the groove 3031 and includes a convex portion 321 and a downwardly projecting pin 320. The pin 320 is slidably received in the channel 4020 of the base 40. The leaf spring 3030 is adapted to downwardly press the slider 32 thereby preventing the pin 320 of the slider 32 from becoming disengaged from the cam channel 4020.

The rod 30 forms an elongate post 3021 to which the spring 33 is assembled. The spring 33 abuts against a stop portion 401 of the base 40 thereby providing elastic contact between the base 40 and the rod 30. A depression 305 is defined in a top surface of the rod 30.

The bracket 41 receives the rod 30 and the base 40. The bracket 41 includes a central wall 413, an upper side wall 414 and a lower side wall 415 extending from opposite edges of the central wall 413. Each side wall 414, 415 forms a plurality of latches 412 along edges thereof for engaging with a lateral edge of the shielding cover 2 thereby securing the actuation means 4 thereto. A first mounting hole 411 and an aperture 410 aligned with the depression 305 are defined in the upper side wall 414.

The PC card connector further includes an elongate lock plate 42 mounted to the bracket 41. The lock plate 42 includes a second mounting hole 422 proximate one end thereof aligned with the first mounting hole 411, a stop tab 420 and a spring tab 421 both proximate another end thereof. The stop tab 420 extends from the lock plate 42 in a direction parallel to a longitudinal direction of the lock plate 42 and is downwardly deformed. The spring tab 421 is substantially T-shaped and in an offset manner extends from a lateral edge of the lock plate 42. The spring tab 421 has an elongate contact portion 4210 substantially extending parallel to a direction in which the PC card 24 is inserted into the PC card connector. The contact portion 4210 has a pair of opposite upwardly bent ends thereby providing the contact portion 4210 with an arcuate cross-section.

Figure 3A:
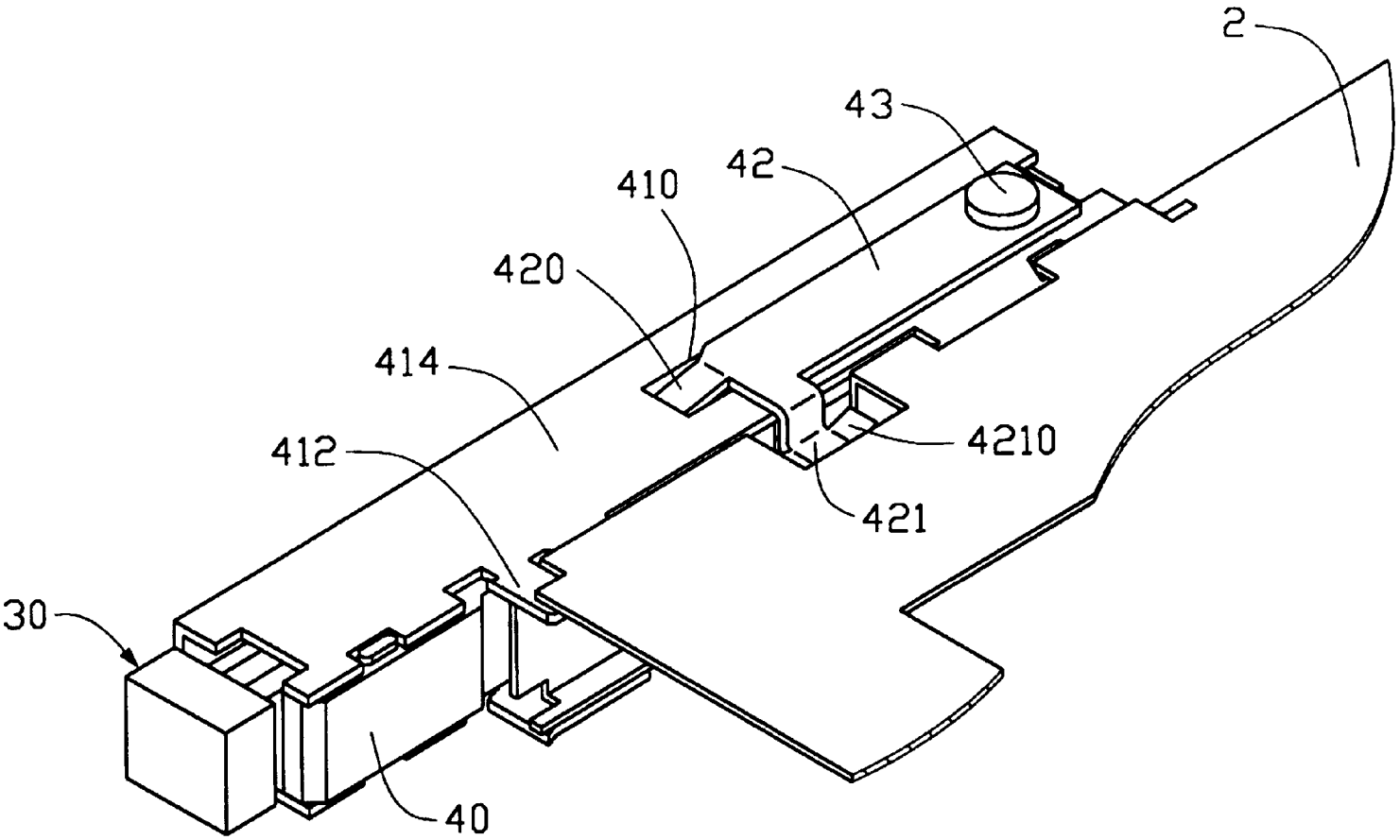
FIG. 3A is a perspective view of an ejector mechanism and a portion of the shielding cover of a PC card connector of the present invention.
Figure 3B:
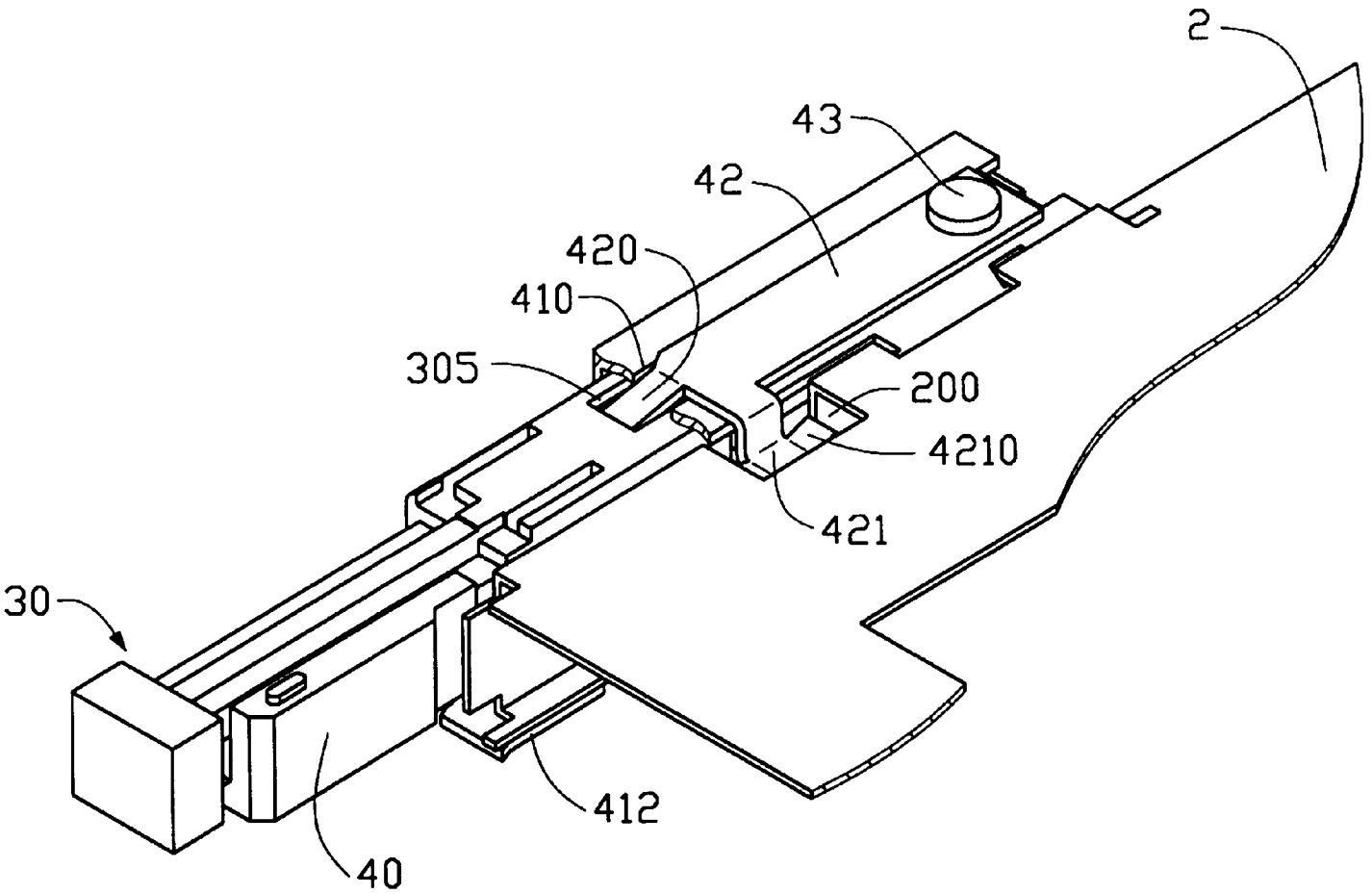
FIG. 3B is similar to FIG. 3A with a part of the bracket being cut away.

Also referring to FIGS. 3A and 3B, in assembly, a screw 43 is inserted through the second mounting hole 422 and the first mounting hole 411 and secures the end of the lock plate 42 to the bracket 41. The shielding cover 2 defines an opening 200 aligned with the spring tab 421 which allows the spring tab 421 to extend into the receiving space 23. When the PC card 24 is not inserted into the PC card connector, the stop tab 420 extends through the aperture 410 of the bracket 41 into the depression 305 of the rod 30 thereby preventing any movement of the rod 30 relative to the bracket 41. Therefore, the rod 30 is reliably held inside the bracket 41 and can not be actuated and damaged by a chance external force.

Also referring to FIGS. 5A and 5B, when the PC card 24 is inserted into the PC card connector, an upper surface of the PC card 24 upwardly abuts against the spring tab 421 and deflects the lock plate 42 relative to the end thereof secured to the bracket 41 by the screw. Therefore, the stop tab 420 is raised and moves out of the depression 305, and the rod 30 becomes forwardly and rearwardly movable. The arcuate cross-section of the contact portion 4210 facilitates the insertion of the PC card 24.

Figure 4A:
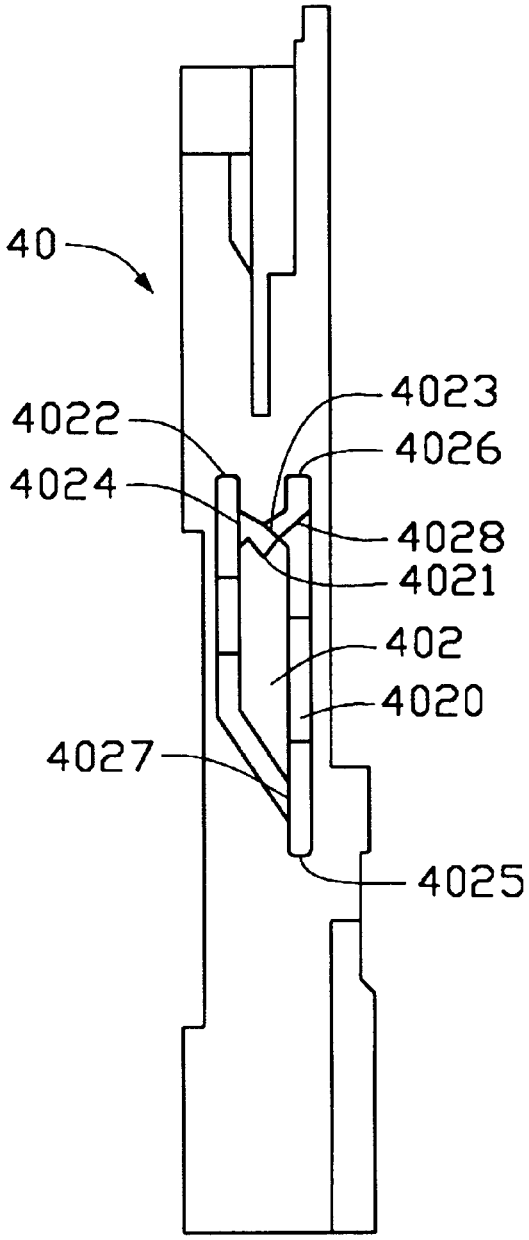
FIG. 4A is a top view of a base of the ejector mechanism to show a cam channel.
Figure 4B:
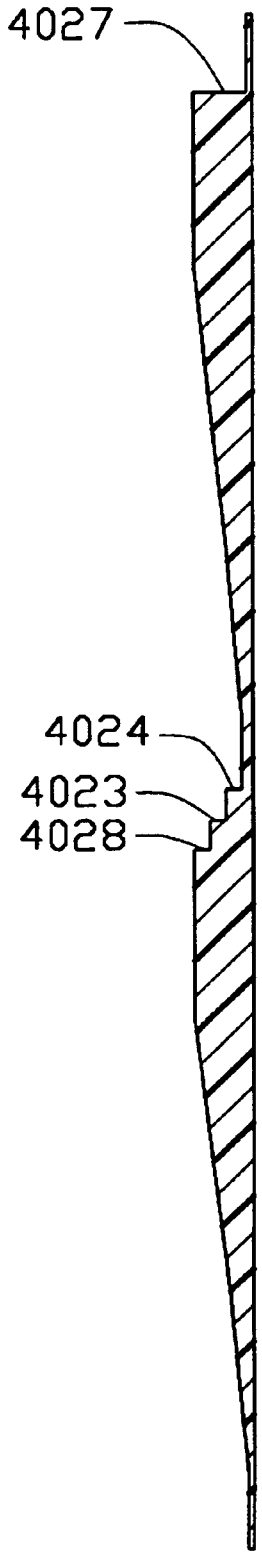
FIG. 4B is a cross-sectional representation of the top graphical elevation inside the cam channel of FIG. 4A.

Also referring to FIGS. 4A and 4B, in its retracted position the rod 30 compresses the spring 33 to a near minimum value and the pin 320 of the slider 32 rests at an inner first notch 4021 of the channel 4020. To eject the PC card 24, the rod 30 is manually pushed inward. An inner end (not shown) of the groove 3031 of the rod 30 rearwardly pushes the slider 32 thereby causing the pin 320 to move from the first notch 4021 to a second notch 4022. A first step 4023 formed in the channel 4020 prevents the pin 320 from moving inversely in an inverted direction. Similarly, a second step 4024 is formed in the channel 4020 for preventing the pin 320 of the slider 32 from moving back to the first notch 4021. The spring 33 expands to a maximum length thereby forwardly pushing the rod 30. An inner wall 3032 of the recess 303 forwardly pushes the slider 32 until the pin 320 is located in an outer third notch 4025. The rod 30 is then manually pushed again to cause the pin 320 of the slider 32 to move from the third notch 4025 to a fourth notch 4026. During this process, the convex portion 321 of the slider 32 rearwardly pushes the second end 342 of the second lever 34. The second lever 34 then pivotally pushes the first lever 35 to eject the PC card 24 out of the header connector 21. A third step 4027 is formed in the channel 4020 for preventing the pin 320 from moving back to the second notch 4022. The spring 33 compresses to the minimum length once again. The elastic recovery force of the spring 33 causes the pin 320 to move from the forth notch 4026 to the first notch 4021. A fourth step 4028 is formed in the channel 4020 for preventing the pin 320 from moving back to the third notch 4025.

While the present invention has been described with reference to a specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

What is claimed is:

1. A PC card connector, comprising:

a header connector including an insulative housing and a plurality of terminals retained in the housing, a receiving space being defined by the housing for receiving an inserted PC card;

a shielding cover assembled to the housing for shielding the header connector and the inserted PC card;

an ejector means mounted to the shielding cover and being adapted to eject the PC card;

a bracket secured to a lateral edge of the shielding cover and including a central wall, an upper side wall and a lower side wall, the upper side wall defining an aperture;

an elongate base fixingly received in the bracket and defining a cam channel;

an elongate rod movably assembled to the base and received in the bracket, the rod defining a depression corresponding to the aperture of the bracket and a groove;

a slider being movably received in the groove and including a pin biased to be slidably received in the cam channel, the slider being adapted to push one end of the ejector means to eject the PC card; and a lock plate having a fixed end and a movable end, the movable end includes a stop tab and a spring tab, the fixed end being secured to the upper wall of the bracket, the stop tab extending through the aperture of the bracket into the depression of the rod, the spring tab being disposed in the way where a PC card is inserted into the receiving space and being upwardly moveable by insertion of the PC card to upwardly move the stop tab out of the depression of the rod;

wherein the spring tab is substantially T-shaped and in an offset manner extending from a lateral edge of the lock plate;

wherein the spring tab has an elongate contact portion extending substantially parallel to a direction in which the PC card is inserted into the PC card connector;

wherein the spring tab has a pair of opposite upwardly bent ends to provide the spring tab with an arcuate cross-section thereby facilitating the insertion and engagement of the PC card;

wherein the stop portion is downwardly bent to extend through the aperture and into the depression;

wherein a first mounting hole is defined in the bracket and a second mounting hole is define in the lock plate, a screw extending through the first and second mounting holes and securing the fixed end of the lock plate to the bracket.

2. An ejector mechanism used in a PC card connector, the PC card connector including a header connector having an insulative housing and a plurality of terminals retained in the housing, a receiving space being defined by the housing for receiving an inserted PC card, a shielding cover being assembled to the housing for shielding the header connector and the inserted PC card, the ejector mechanism comprising:

an ejector means mounted to the shielding cover and being adapted to eject the PC card;

a bracket secured to a lateral edge of the shielding cover and including a central wall, an upper side wall and a lower side wall, the upper side wall defining an aperture;

an elongate base fixingly received in the bracket and defining a cam channel;

an elongate rod movably assembled to the base and received in the bracket, the rod defining a depression corresponding to the aperture of the bracket and a groove;

a slider being movably received in the groove and including a pin biased to be slidably received in the cam channel, the slider being adapted to push one end of the ejector means to eject the PC card; and a lock plate having a fixed end and a movable end, the movable end includes a stop tab and a spring tab, the fixed end being secured to the upper wall of the bracket, the stop tab extending through the aperture of the bracket into the depression of the rod, the spring tab being disposed in the way where a PC card is inserted into the receiving space and being upwardly moveable by insertion of the PC card to upwardly move the stop tab out of the depression of the rod;

wherein the spring tab is substantially T-shaped and steppedly extending from a lateral edge of the lock plate;

wherein the spring tab has an elongate contact portion extending substantially parallel to a direction in which the PC card is inserted into the PC card connector;

wherein the spring tab has a pair of opposite upwardly bent ends to provide the spring tab with an arcuate cross-section thereby facilitating the insertion and engagement of the PC card;

wherein the stop portion is downwardly bent to extend through the aperture and into the depression;

wherein a first mounting hole is defined in the bracket and a second mounting hole is defined in the lock plate, a screw extending through the first and second mounting holes and securing the fixed end of the lock plate to the bracket.

3. A PC card connector assembly including a header connector and an associated PC card, comprising:

the header connector defining a housing with a plurality of terminals therein;

an ejector means positioned around the housing and adapted to eject the inserted PC card therefrom;

a bracket positioned by a lateral side of the housing;

a rod axially moveably positioned along the bracket and actuating said ejector means correspondingly; and a lock plate positioned around the bracket and including a stop tab releasably engaged with the rod, and a spring tab extending into a space of said connector occupied by the inserted PC card; wherein when said PC card is inserted into the space and presses the spring tab, the stop tab is disengaged from the rod so that the rod can move and actuate the ejector means to eject the inserted PC card out of the connector; when the PC card is not in the space or has been ejected out of the space and leaves the spring tab, the stop tab is latchably engaged with the rod so that the rod can not inadvertently axially move with regard to the connector for safety consideration;

wherein the connector further includes a slider positioned between the rod and the ejector means, thus being adapted to be actuated by the rod and actuate the ejector means correspondingly;

wherein said base defines a cam channel, with an inner notch and an outer notch thereof, along which the slider moves, and wherein the slider can move to the outer notch only when the PC card is received within the connector.

* * * * *